US012331617B2

(12) United States Patent
Grace

(10) Patent No.: US 12,331,617 B2
(45) Date of Patent: Jun. 17, 2025

(54) INTEGRATED JUNCTION AND DEFLECTOR ASSEMBLY FOR MULTILATERAL WELL CONTROL

(71) Applicant: Halliburton Energy Services, Inc., Houston, TX (US)

(72) Inventor: Christopher A. Grace, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 151 days.

(21) Appl. No.: 18/156,888

(22) Filed: Jan. 19, 2023

(65) Prior Publication Data

US 2024/0247568 A1 Jul. 25, 2024

(51) Int. Cl.
*E21B 41/00* (2006.01)

(52) U.S. Cl.
CPC ..... *E21B 41/0042* (2013.01)

(58) Field of Classification Search
CPC ..... E21B 41/0042; E21B 41/0035
See application file for complete search history.

(56) References Cited

U.S. PATENT DOCUMENTS

| | | | | |
|---|---|---|---|---|
| 5,474,131 | A | 12/1995 | Jordan, Jr. et al. | |
| 9,303,490 | B2 | 4/2016 | Pendleton | |
| 11,486,231 | B1 | 11/2022 | Rowaihy et al. | |
| 2010/0276158 | A1* | 11/2010 | Ingraham | E21B 23/12 166/241.1 |
| 2015/0233190 | A1* | 8/2015 | Wolf | E21B 41/0035 166/380 |
| 2021/0172265 | A1 | 6/2021 | Steele et al. | |

FOREIGN PATENT DOCUMENTS

| | | |
|---|---|---|
| EP | 2986807 | 4/2018 |

OTHER PUBLICATIONS

"PCT Application No. PCT/US2023/061031, International Search Report and Written Opinion", Oct. 11, 2023, 12 pages.

* cited by examiner

*Primary Examiner* — James G Sayre
(74) *Attorney, Agent, or Firm* — DeLizio, Peacock, Lewin & Guerra LLP

(57) ABSTRACT

A multi-bore junction assembly to be positioned in a multilateral well having a main wellbore and a lateral wellbore, wherein the multilateral well has an up-hole end and a downhole end, the multi-bore junction assembly comprises a deflector subassembly to be positioned at a junction between the main wellbore and the lateral wellbore. The deflector subassembly comprises a deflector sub that comprises, a first deflector bore at an up-hole end of the deflector sub, a second deflector bore at a downhole end of the deflector sub, wherein the second deflector bore is radially offset from the first deflector bore, a seal stinger to project from the second deflector bore, and a slot sub. Additionally, the multi-bore junction assembly comprises an outer sleeve positioned around the deflector subassembly, the outer sleeve having at least one pin, wherein the slot sub is to interact with the at least one pin.

20 Claims, 9 Drawing Sheets

INTEGRATED JUNCTION AND DEFLECTOR ASSEMBLY FOR MULTILATERAL WELL CONTROL

FIELD

Embodiments of the inventive subject matter relate generally to the field of hydrocarbon recovery that includes multilateral wells and more particularly to the field of multilateral well junction assembly tools.

BACKGROUND

In multilateral wells, a junction may be used to control segregated production flow from a main bore and a lateral bore. Often, it is required that the junction allow for mechanical intervention into one or both legs of the junction (along with their respective wellbores). Typically, the junction is configured to allow access to one bore but not the other. If access to the other bore is required, conventional configurations may include removal of some sort of isolation sleeve from the junction and then installing a deflector ramp to direct an intervention assembly into the second junction leg and its well bore.

BRIEF DESCRIPTION OF THE DRAWINGS

Embodiments of the disclosure may be better understood by referencing the accompanying drawings.

DESCRIPTION

Figure 1:
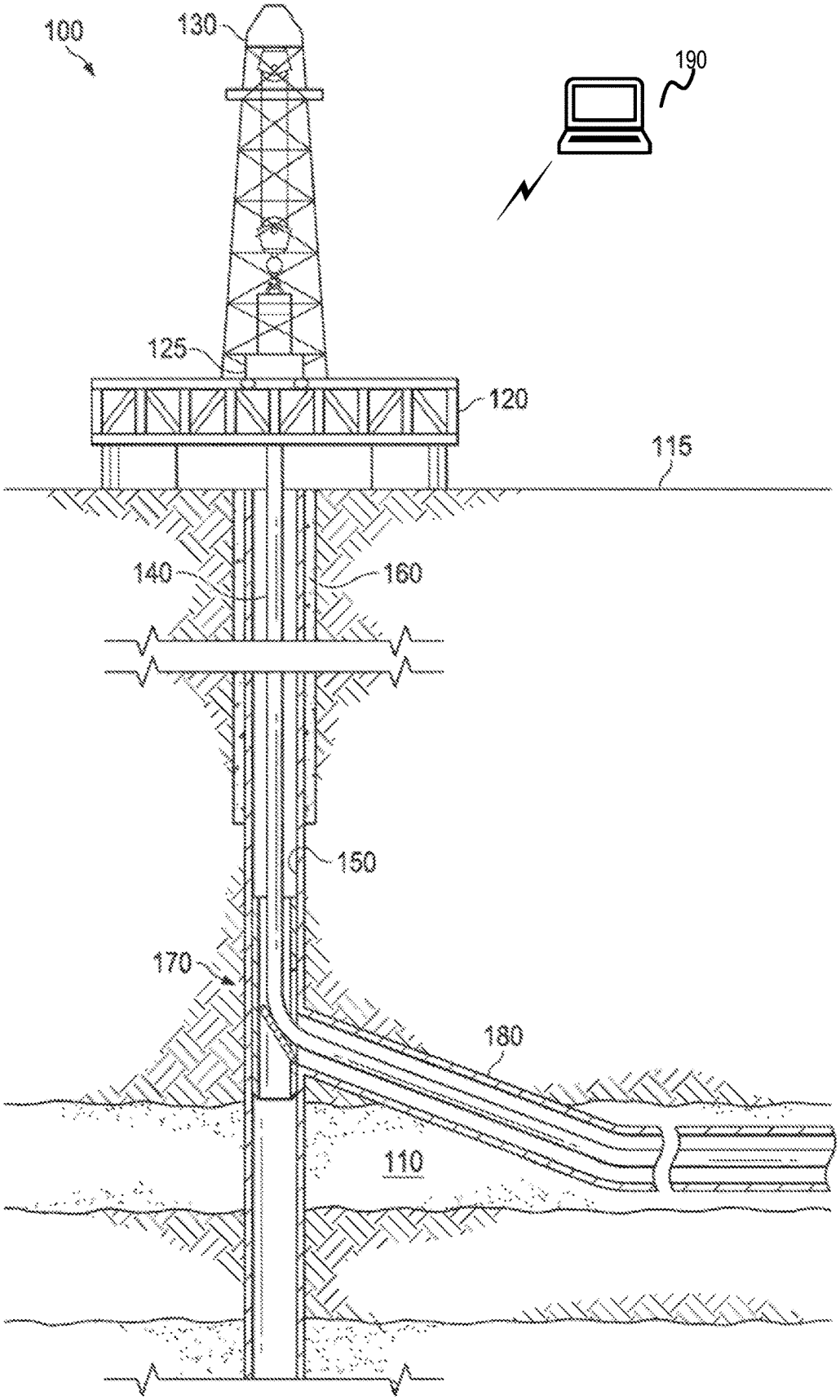
FIG. 1 depicts a schematic view of a multilateral well, according to some embodiments.

The description that follows includes example systems, methods, techniques, and program flows that embody aspects of the disclosure. However, it is understood that this disclosure may be practiced without these specific details. For instance, this disclosure refers to the position of various components of a multi-bore junction assembly relative to each other. Aspects of this disclosure may also be applied to any other configuration of components in a multi-bore junction assembly. In other instances, well-known instruction instances, protocols, structures, and techniques have not been shown in detail in order not to obfuscate the description.

Example embodiments relate to multilateral wells drilled in a subsurface formation. Multilateral wells may include one or more lateral wellbores extending from a main wellbore. A lateral wellbore may be any wellbore that is diverted from a main wellbore. In some embodiments, a multi-bore junction assembly may be positioned proximate a junction in the multilateral wells between the main wellbore and lateral wellbore. Such embodiments may allow intervention access to the main wellbore and the lateral wellbore and provide segregation of fluid produced from the respective wellbores.

In some example embodiments, the multi-bore junction assembly may be configured with a Y-block junction and a deflector subassembly that may be configured to direct an intervention assembly to the desired wellbore, without the need to remove or install mechanisms such as an isolation sub, a deflector ramp, etc. Such embodiments may reduce the number of trips required to perform mechanical intervention and therefore reduce cost.

Some implementations may include a junction and a deflector assembly that is configurable to allow access to a desired wellbore leg without removal of an isolation sleeve or installation of a deflector tool. Such embodiments integrates both tools (the Y-block junction and the deflector subassembly) into the multi-bore junction assembly so that the main wellbore and one or more lateral wellbores may be hydraulically isolated. Also, such embodiments may provide for pressure isolation and the presence of the deflector function. In such embodiments, the deflector function may not need to be removed. Some implementations may also include sensors and intelligent casing for monitoring and controlling operations of the multi-bore junction assembly.

In some implementations, the multi-bore junction assembly may include a Y-block sub at the downhole end of the multi-bore junction assembly. The Y-block sub may have at least two unique bores, one positioned in the main wellbore and the remaining bores positioned in the lateral wellbores. At the up-hole end of the Y-block sub, each bore may have an identical seal stinger receptacle for the purpose of receiving a seal stinger. The deflector subassembly may be positioned on the up-hole end of the Y-block sub. The deflector subassembly may include a deflector sub with an internal diameter (ID) bore that may be centralized at the up-hole end of the deflector subassembly and radially offset at the downhole end of the deflector subassembly. The deflector sub assembly may also include a seal stinger that projects from the offset bore at the downhole end and may be received by the stinger receptacles in each of the bores in the Y-block sub. The deflector sub assembly may also include a J-Slot sub that is positioned near the up-hole end of the deflector sub. In some implementations, the J-Slot sub may interact with the pins attached to an outer sleeve. The deflector sub assembly may include a top cap sub that holds the J-Slot sub in place and that may allow annular fluid flow to pass.

In some implementations, the deflector sub assembly may be positioned within an outer sleeve. The downhole end of outer sleeve may be coupled to the Y-block and the up-hole end of the outer sleeve may be coupled to a central stinger sub. In some implementations, two or more pins may be installed into the outer sleeve. The two pins may be oriented radially inward. The pins may interact with the J-slots of the J-Slot sub of the deflector subassembly to control the orientation of the deflector subassembly as it is cycled in an up-hole and downhole motion.

The central stinger sub may be positioned up-hole of the outer sleeve and the deflector subassembly. The central stinger sub may have a bore that may be centralized with the central bore of the deflector sub. The central stinger sub may include a seal stinger that may be positioned within the central bore of the deflector sub. The central stinger sub may also include ports offset from the central axis of the bore to allow fluid passage from the bore of the Y-block that the deflector sub is not stabbed into. For example, if the deflector sub is stabbed into the bore of the Y-block that is positioned in the main wellbore, fluid from the main wellbore may flow up-hole via the central bore of the deflector sub assembly and the bore of the central stinger sub. The fluid from the lateral wellbore may flow up-hole via the annulus between the deflector sub and the outer shell, and then continue to flow up-hole via the ports of the central stinger sub. Hence, fluid communicated through the central bore is segregated from the fluid that passes through the offset ports. A bias mechanism (such as a spring assembly) may be positioned over the down hole end of the central stinger sub and may be compressed against the up-hole end of the deflector subassembly when the central stinger sub is stabbed into the deflector subassembly. This bias mechanism may oppose the up-hole translation of the deflector sub assembly as it cycles through positions and acts to hold the deflector subassembly in the downhole, production configuration.

Up-hole of the central stinger sub may include another outer sleeve (i.e., casing) that may extend up to a junction anchor point (such as a packer). Also connected to the up-hole side of the central stinger sub may be a polished bore receptacle (PBR) and a scoop head assembly. The PBR may be positioned to the central bore of the central stinger sub. In some embodiments, an upper completion stinger may be positioned in the PBR. This configuration may allow fluid flow to reach the upper completion assembly in a segregated state. In some embodiments, one or more control valves may be utilized to comingle the fluid produced from each wellbore in the upper completion.

The J-Slot design in the deflector subassembly may be such that after the deflector subassembly assembly is pushed fully in the downhole direction, the seal stinger may be installed into either one of the Y-block sub bores. After the deflector subassembly is pulled to its most up-hole position and then pushed back to its most downhole position, it may rotate 180 degrees about the multi-bore junction assembly's central axis and the seal stinger may be installed into the opposite Y-block bore from where it initially started. Another cycle of the deflector sub assembly may again switch the Y-block sub bore the seal stinger is stabbed into. Because of the usage and placement of seals in the mating components of the seal stinger and seal stinger receptacles in the multi-bore junction assembly, segregated flow and pressure isolation of the two fluid paths may be maintained throughout the multi-bore junction assembly and regardless of the Y-block bore that the seal stinger of the deflector sub may be landed into.

In some implementations, to move the deflector subassembly between the two bores, a shifting tool may be landed in a receiving profile within the central bore of the deflector subassembly. The shifting tool may be attached to an intervention string (i.e., coil tubing, slick line, wire line, etc.) and may be landed in the receiving profile of the deflector subassembly. The shifting tool may then pull up-hole and then push downhole on the deflector subassembly, cycling the seal stinger to the other Y-block bore.

In some embodiments, the orientation of the deflector subassembly may be detected at the surface of the wellbore by varying the length of the J-slots in the J-Slot sub. For example, shifting the seal stinger from main wellbore to lateral wellbore could allow 50 inches of up-hole stroke, while shifting from lateral wellbore to main wellbore may only use 30 inches of up-hole stroke. Orientation of the deflector subassembly may also be obtained by sensors placed in the multi-bore junction assembly. For example, sensors may be placed on the deflector subassembly and in the outer sleeve. The sensors may communicate after these sensors are in close proximity relative to each other, which may correspond to a specific deflector subassembly orientation.

Example System

FIG. 1 depicts a schematic view of a multilateral well, according to some embodiments. In FIG. 1, a multilateral well 100 may include a platform 120 positioned over a formation 110 located below the earth's surface 115. In some implementations, the platform 120 may include a hoisting apparatus 125 and a derrick 130 for raising and lowering equipment (such as a pipe string 140).

As shown, a main wellbore 150 has been drilled through the various earth strata, including the formation 110. The term "main" wellbore is used herein to designate a wellbore from which another wellbore is drilled. The main wellbore 150 may not necessarily extend directly to the earth's surface, but could instead be a branch of yet another wellbore. A casing string 160 may be at least partially cemented within the main wellbore 150. The casing string 160 may be any type of a tubular string used to line a wellbore. The casing string 160 may be made of any material, such as steel or composite material and may be segmented or continuous, such as coiled tubing.

Figure 2A:
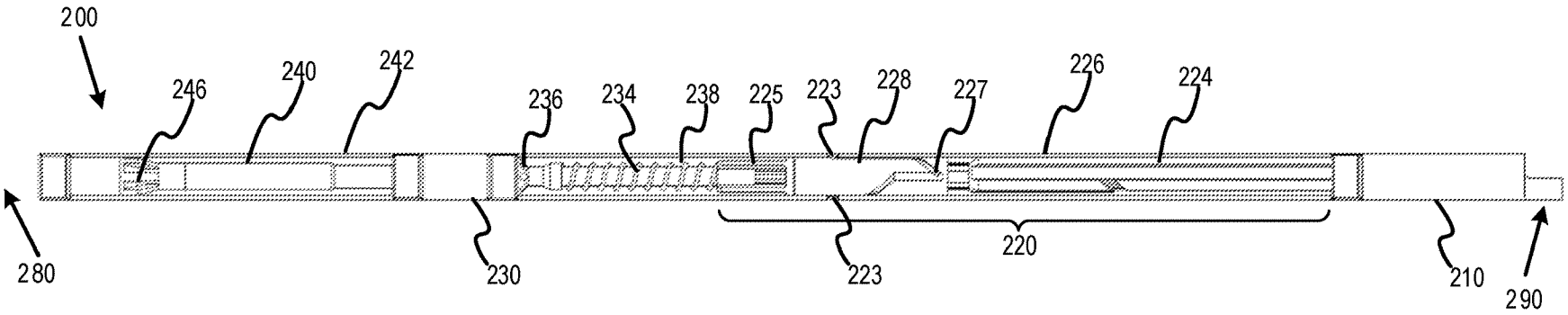
FIGS. 2A-2B depict schematics of an example multi-bore junction assembly, according to some embodiments.
Figure 2B:
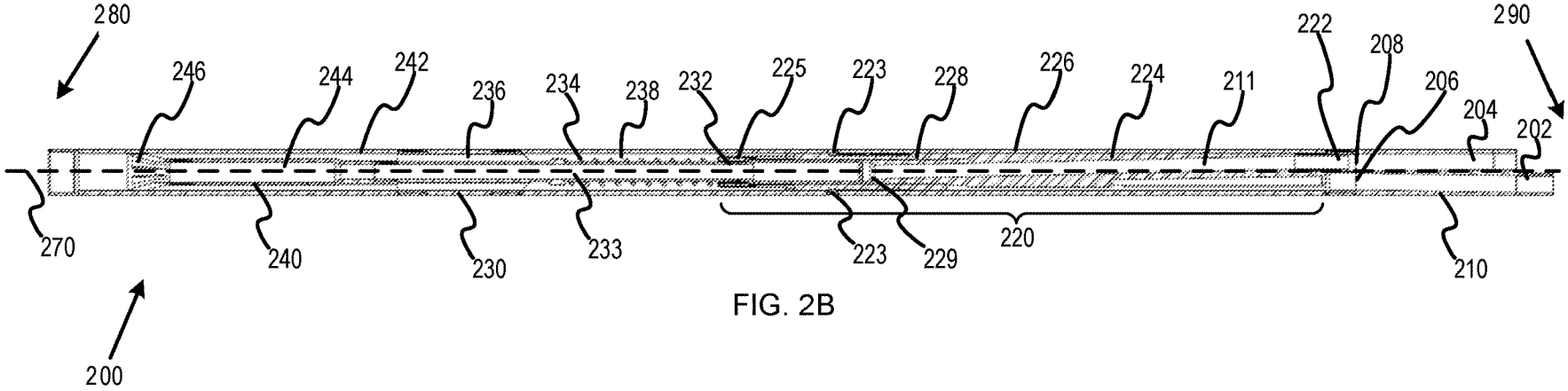

A multi-bore junction assembly 170 may be positioned at a desired intersection between the main wellbore 150 and a lateral wellbore 180. The lateral wellbore 180 may be any type of wellbore that is drilled outwardly from its intersection with another wellbore, such as the main wellbore 150. Moreover, a lateral wellbore 180 may have another lateral wellbore drilled outwardly therefrom. Example embodiments of the multi-bore junction assembly 170 are depicted in FIGS. 2A-2B and further described below. As further described below, the multi-bore junction assembly 170 may be configured to direct an intervention assembly to the desired wellbore, without the need to remove an isolation sub or install a deflector ramp. Such embodiments may reduce the number of trips required to perform mechanical intervention and therefore reduce costs of operations.

Figure 5:
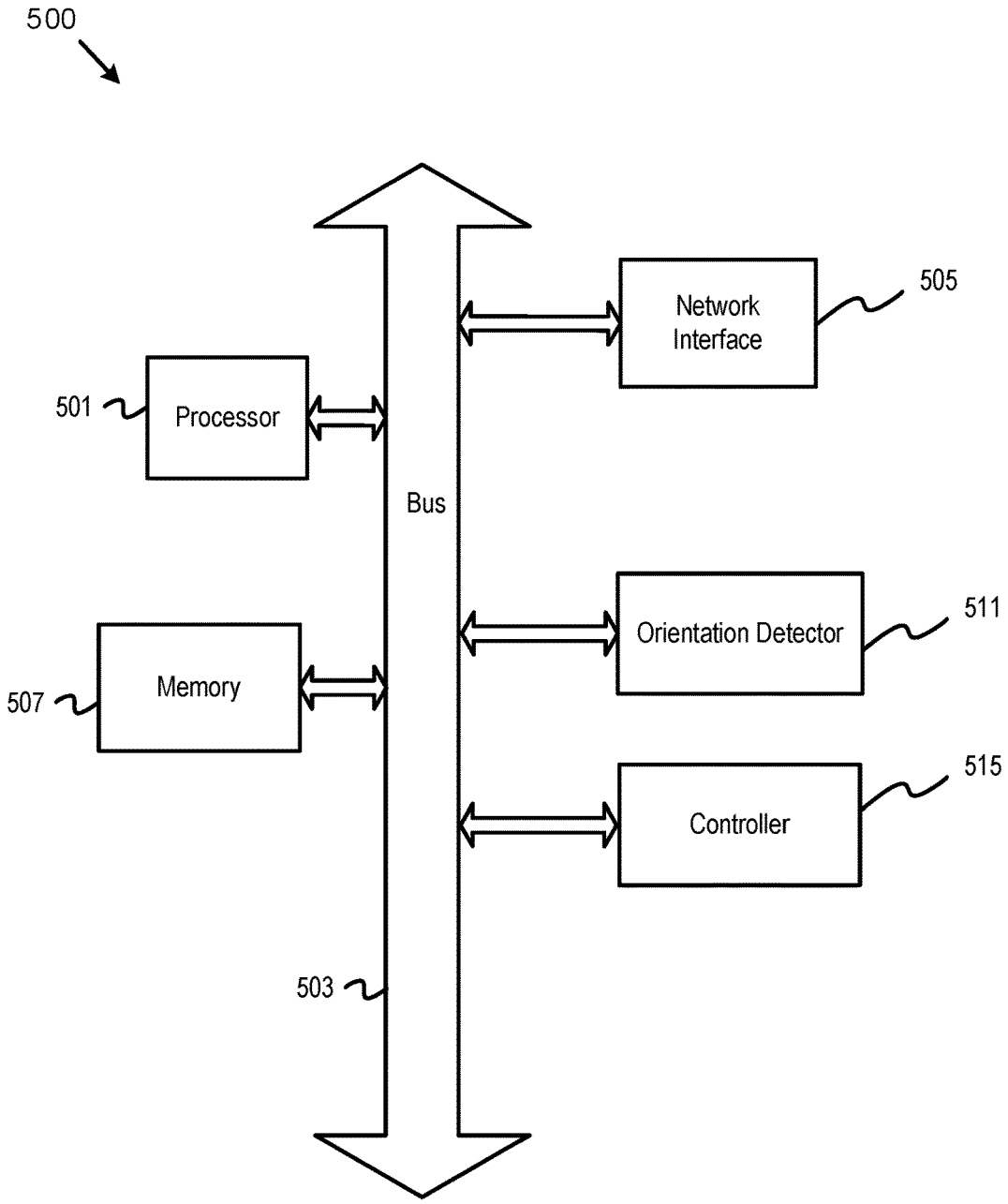
FIG. 5 depicts an example computer, according to some embodiments.

The multilateral well 100 includes a computer 190 that may be communicatively coupled to other parts of the multilateral well 100 such as sensors on surface 115, the multi-bore junction assembly 170, etc. Additionally, the computer 190 may be communicatively coupled to other systems such as an intervention system (not pictured). The computer 190 may be local or remote to the platform 120. A processor of the computer 190 may have perform commands (as further described below) that position the deflector subassembly in the multi-bore junction assembly 170 and/or detect the orientation of the multi-bore junction assembly 170. In some embodiments, the processor of the computer 190 may control intervention operations of the multilateral well 100 or subsequent intervention operations of other wellbores. An example of the computer 190 is depicted in FIG. 5, which is further described below.

Example Multi-Bore Junction Assembly

Examples of a multi-bore junction assembly are now described.

FIGS. 2A-2B depict schematics of an example multi-bore junction assembly, according to some embodiments. In particular, FIGS. 2A-2B depict an example multi-bore junction assembly 200. FIGS. 2A-2B depict a perspective view and cross-sectional view, respectively, of the multi-bore junction assembly 200. The multi-bore junction assembly 200 comprises a Y-block sub 210, a deflector subassembly 220, a central stinger sub 230, and a polished bore receptacle (PBR) 240. The multi-bore junction assembly 200 may be positioned proximate a junction of a multilateral well, such as where a lateral wellbore branches from a main wellbore. For example, with reference to FIG. 1, the multi-bore junction assembly 200 may be an example of the multi-bore junction assembly 170. The multi-bore junction assembly 200 is described in reference to an up-hole end 280 and a downhole end 290. The up-hole end 280 may be the end of the multi-bore junction assembly 200 that is nearest to the surface of the wellbore, and the downhole end 290 may be the end of the multi-bore junction assembly furthest from the surface. Additionally, the multi-bore junction assembly is described with reference to a central axis 270. The central axis 270 may be the longitudinal axis of the multi-bore junction assembly 200.

A Y-block sub 210 may be positioned at the downhole end of the multi-bore junction assembly 200. The Y-block sub 210 may include two or more unique bores. FIGS. 2A-2B depict a Y-block sub 210 with two bores; a main Y-block bore 202 and a lateral Y-block bore 204. The multi-bore junction assembly 200 may be positioned such that the main Y-block bore 202 may be positioned in the main wellbore of the multilateral well and the lateral Y-block bore 204 may be positioned in the lateral wellbore of the multilateral bore. In some embodiments, the internal diameter of the main Y-block bore 202 and the lateral Y-block bore 204 may be different. For example, the main Y-block bore 202 may have an internal diameter that is greater than the lateral Y-block bore 204. A seal stinger receptacle 206 may be positioned at the up-hole end of the main Y-block bore 202. Additionally, a seal stinger receptacle 208 may be positioned at the up-hole end of the lateral Y-block bore 204. The profiles of the seal stinger receptacles 206, 208 may be similar such that each seal stinger receptacle 206, 208 may be configured to receive the seal stinger 222 of the deflector subassembly 220 as described below.

A deflector subassembly 220 may be positioned at the up-hole end of the Y-block sub 210. The deflector subassembly 220 may include a deflector sub 224. The deflector sub 224 may include a deflector sub bore 211 that may be central to the central axis 270 of the of the multi-bore junction assembly 200 at the up-hole end of the deflector sub 224 and radially offset at the downhole end of the deflector sub 224. A seal stinger 222 may be positioned on the downhole end of the deflector sub 224. The seal stinger 222 may be configured such that it may be inserted into either of the seal stinger receptacles 206, 208. The seal stinger 222 may be configured with sealing components (e.g., O-rings) such that fluid produced from the respective wellbores (i.e., the main wellbore and the lateral wellbore) may be segregated as is flows through the multi-bore junction assembly 200 when the seal stinger 222 is stabbed into either bore of the Y-block sub 210. For example, if the seal stinger 222 is positioned in the main Y-block bore 202, fluid produced from the main wellbore will flow from the main Y-block bore 202 to the deflector sub bore 211. Fluid produced from the lateral wellbore will flow up the lateral Y-block bore 204 to the annulus 238 between the deflector subassembly 220 and the lower outer sleeve 226. The deflector sub 224 may also include a receiving profile 229. The receiving profile 229 may include a profile configured to receive a shifting tool to function the deflector subassembly 220. Functioning the deflector subassembly 220 will be described in FIG. 3 and FIGS. 4A-4E.

The deflector subassembly 220 may also include a J-slot sub 228. The J-slot sub 228 may be positioned near the up-hole end and on the outside of the deflector sub 224. J-slots 227 may be positioned on the outer face of the J-slot sub 228. The profile of the J-slots 227 may be configured to interact with pins 223 positioned on lower outer sleeve 226. The J-slot sub 228 may include ports (not pictured) that are radially offset from the central axis 270 to allow fluid to flow in the annulus 238. A top cap sub 225 may be positioned at the up-hole end of the J-slot sub 228. The top cap sub 225 may also be coupled to the up-hole end of the deflector sub 224 such that the J-slot sub 228 may be coupled to the deflector sub 224 via the top cap sub 225.

The deflector subassembly 220 may be positioned inside of the lower outer sleeve 226. The downhole end of the lower outer sleeve 226 may be positioned at the up-hole end of the Y-block sub 210 and the up-hole end of the lower outer sleeve 226 may be coupled to the central stinger sub 230. Pins 223 may be positioned on the inside face of the lower outer sleeve 226. The pins 223 are oriented radially inward and may interact with the J-slots 227 on the J-slot sub 228 to control the orientation of the deflector subassembly 220 as it is cycled. As previously mentioned, the lower outer sleeve 226 may create an annulus 238 for fluid passage from the wellbore that the seal stinger 222 is not stabbed into.

A central stinger sub 230 may be positioned at the up-hole end of the lower outer sleeve 226 and deflector subassembly 220. The central stinger sub 230 may include a central stinger sub bore 233 that may be centralized with the up-hole end of the deflector sub bore 211. A central stinger sub seal stinger 232 may be positioned at the downhole end of the central stinger sub 230. The central stinger sub seal stinger 232 may be positioned inside the deflector sub bore 211. The central stinger sub seal stinger 232 may be configured to allow the deflector subassembly 220 to move longitudinally along the central axis 270 and rotate around the central axis 270. The central stinger sub seal stinger 232 may be configured with sealing elements (e.g., O-rings) such that pressure isolation and fluid segregation may be maintained between the annulus 238 and the bores of the deflector sub 224 and the central stinger sub 230 (deflector sub bore 211 and a central stinger sub bore 233, respectively). The central stinger sub 230 may include ports 236 to allow fluid in the annulus 238 to flow past the central stinger sub 230 and to the upper completion assembly.

A positioning mechanism 234 may be positioned at the downhole end and outside of the central stinger sub 230. Additionally, the positioning mechanism 234 may be positioned up-hole end of the deflector subassembly 220. In some embodiments, the positioning mechanism 234 may include a bias mechanism such as a spring assembly. The spring assembly may be configured to urge the deflector subassembly 220 in the downhole direction, thus holding the seal stinger 222 into either of the seal stinger receptacles 206, 208. For example, an unstressed position of the spring assembly may correspond to the deflector subassembly 220 being in the most downhole position. When the deflector subassembly 220 is moved in the up-hole direction, the spring assembly may become compressed against the up-hole end of the deflector subassembly 220. FIGS. 2A-2B depict the positioning mechanism 234 as a spring assembly. Alternate embodiments may use other mechanisms for the positioning mechanism 234. In some embodiments, the positioning mechanism 234 may include a latch mechanism that may hold the deflector subassembly 220 in the most downhole position (i.e., when the seal stinger 222 is positioned in either of the seal stinger receptacles 206, 208). The latch mechanism may be released to allow the deflector subassembly 220 to move in the up-hole direction. Operations for controlling the deflector subassembly via the positioning mechanism 234 will be described in FIG. 3 and FIGS. 4A-4E.

A polished bore receptacle (PBR) 240 may be positioned at the up-hole end of the central stinger sub 230. The PBR central bore 244 may be centralized with the central axis 270 and centralized with the up-hole end of the central stinger sub bore 233. Thus, fluid produced from the respective wellbore that the seal stinger 222 is positioned in will flow through the respective bore of the Y-block sub 210, through the deflector sub bore 211, through central stinger sub bore 233, and through the PBR central bore 244. In some embodiments, the downhole end of the PBR 240 may include a profile that may be configured to accept an upper completion stinger (not pictured). In some embodiments, a scoop head assembly 246 may be positioned at the up-hole end of the PBR 240. The PBR 240 and scoop head assembly 246 may be positioned inside an upper outer sleeve 242. The upper outer sleeve 242 may be positioned at the up-hole end of the central stinger sub 230. In some embodiments, one or more flow control devices, such as an internal control (ICV) valve, may be positioned up-hole of the PBR 240 and scoop head assembly 246, within the upper outer sleeve 242. Additionally, the upper outer sleeve 242 may extend up-hole and be coupled with a junction anchor point (e.g., a packer).

Example Operations

Example operations for operating or controlling a multi-bore junction assembly are now described in reference to FIG. 3 and FIGS. 4A-4E.

Figure 3:
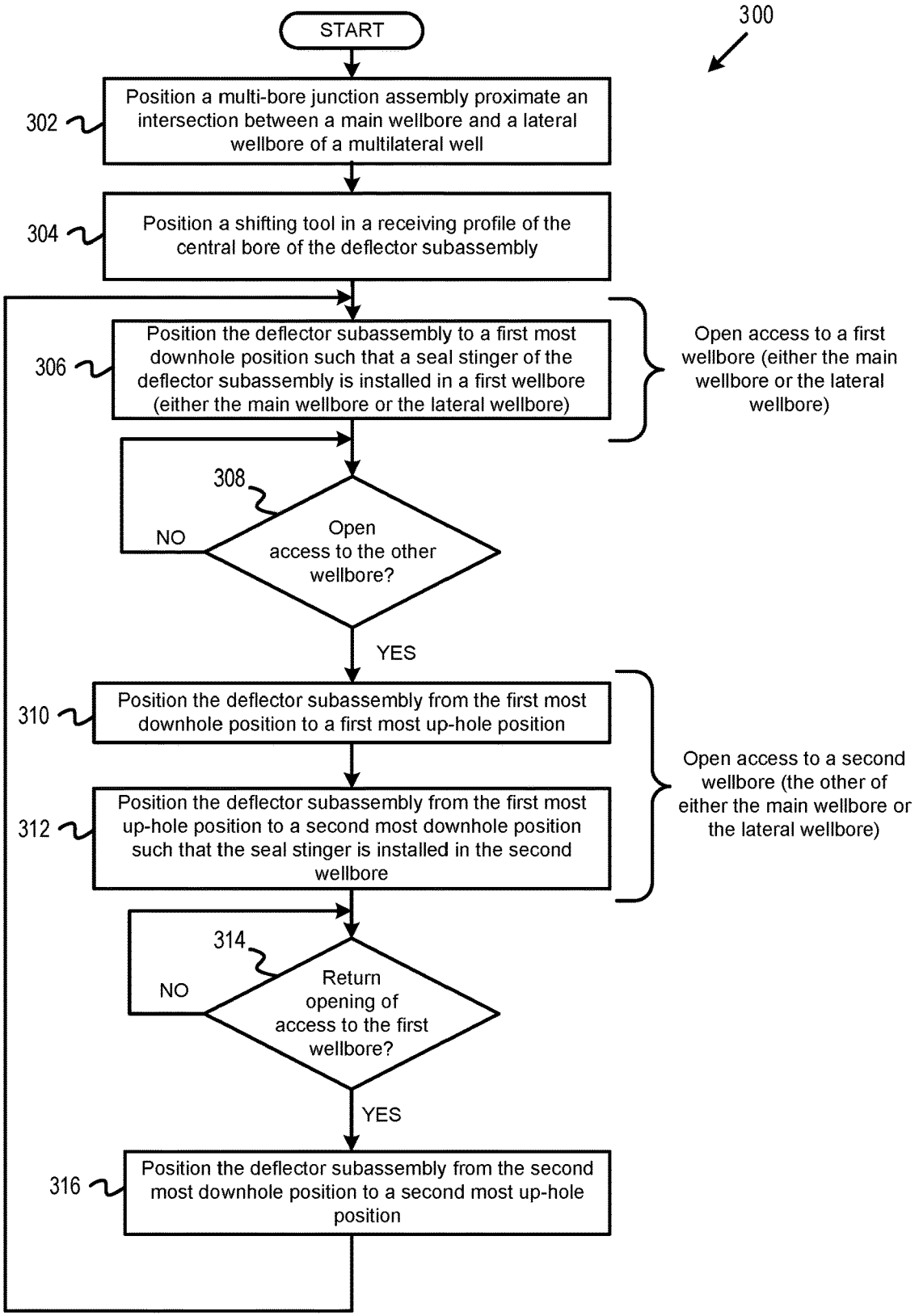
FIG. 3 depicts a flowchart of example operations for operating or controlling a multi-bore junction assembly, according to some embodiments.

FIG. 3 depicts a flowchart of example operations for operating or controlling a multi-bore junction assembly, according to some embodiments. FIG. 3 depicts a flowchart 300 of operations to function the deflector subassembly within the multi-bore junction assembly. The computer 190 of FIG. 1 may perform any or all of the operations described with reference to FIG. 3. Alternatively, or in addition, any or all of such operations may be performed manually. Operations are described in reference to the multi-bore junction assembly 170 positioned in the multilateral well 100 of FIG. 1 and the multi-bore junction assembly 200 of FIG. 2. To help illustrate the operations of flowchart 300, FIGS. 4A-4E depict schematics of an example deflector subassembly in various positions, according to some embodiments.

FIGS. 4A-4E depict a multi-bore junction assembly 400. The deflector subassembly 420 of the multi-bore junction assembly 400 may include a seal stinger 422 positioned on the downhole end of the deflector sub 424. The seal stinger 422 may be positioned into the Y-block sub 410 via either of the seal stinger receptacles 406, 408 of the main Y-block bore 402 or the lateral Y-block bore 404, respectively. The deflector subassembly 420 may include a receiving profile 429 located at the up-hole end of the deflector sub bore 411. A J-slot sub 428 may be positioned near the up-hole end of the deflector subassembly 420. The J-slot sub 428 may include J-slots that may interact with pins 423 on the lower outer sleeve 426. As the deflector subassembly 420 is moved in the up-hole and downhole direction via a shifting tool landed in the receiving profile 429, the J-slot sub 428 may orient the deflector sub 424 via the J-slots interacting with the pins 423. A central stinger sub 430 may be positioned up-hole of the deflector subassembly 420. A central stinger sub bore 433 may be centralized with the up-hole end of the deflector sub bore 411. Additionally, the central stinger sub 430 may include a positioning mechanism 434 to assist in holding the seal stinger 422 in either seal stinger receptacles 406, 408.

The operations of FIG. 3 are described in reference to a first and most downhole position, a first and second most up-hole position, and a first and second wellbore. Phrases that include "first" and "second are utilized to differentiate between the up-hole and downhole positions and wellbores. For example, a first wellbore may correspond to a lateral wellbore of the multilateral well 100 of FIG. 1. As another example, the first most up-hole position may correspond to the position of the deflector subassembly of the multi-bore junction assembly 170 of FIG. 1 when cycling from the lateral wellbore to the main wellbore.

At block 302, a multi-bore junction assembly is positioned proximate an intersection between a main wellbore and a lateral wellbore of a multilateral well. For example, the computer 190 of FIG. 1 may perform this operation. In some embodiments, the multi-bore junction assembly may be positioned in the multilateral well via casing. For example, the multi-bore junction assembly may be integrated into the casing string that is positioned in the multilateral well after the multilateral well is drilled.

At block 304, a shifting tool is positioned in a receiving profile of the central bore of the deflector subassembly. For example, the computer 190 of FIG. 1 may perform this operation. For instance, the shifting tool may be positioned in the receiving profile 429 of FIGS. 4A-4E. In some embodiments, the shifting tool may be coupled to an intervention string (e.g., coiled tubing, slick line, wire line, etc.).

Figure 4A:
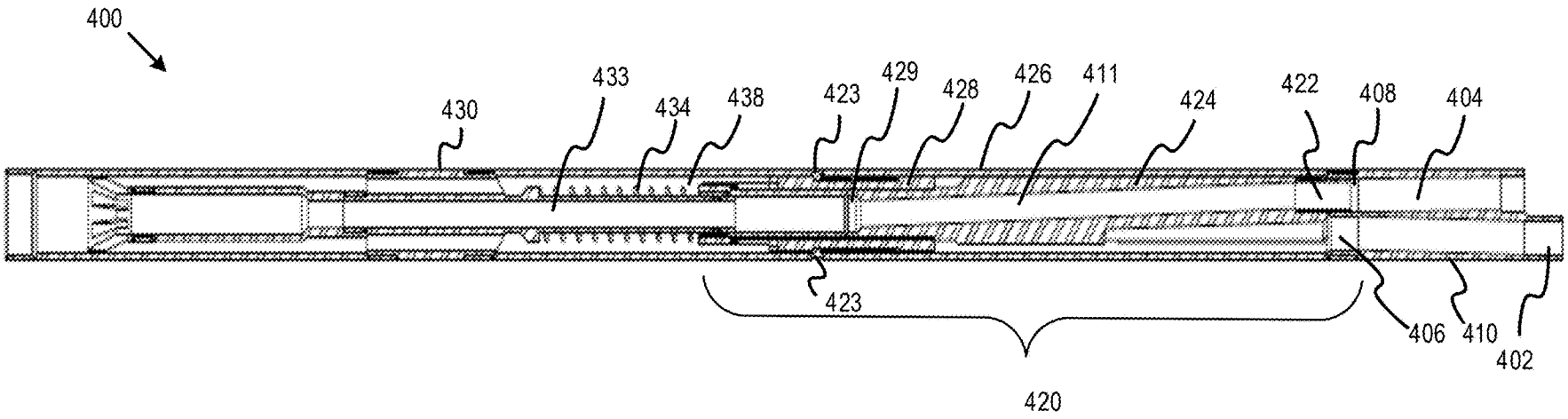
FIGS. 4A-4E depict schematics of an example deflector subassembly in various positions, according to some embodiments.

At block 306, the deflector subassembly may be positioned to a first most downhole position such that the seal stinger of the deflector subassembly is installed in a first wellbore (the main wellbore or the lateral wellbore). For example, the computer 190 of FIG. 1 may perform this operation. The first most downhole position may correspond to the seal stinger being positioned in the first wellbore. The installation of the seal stinger in the first wellbore may open access to the first wellbore. For instance, the access may be opened so an intervention string may enter the first wellbore. In some instances, the access of flow of fluid may be opened to the central bore of the multi-bore junction assembly. For example, FIG. 4A depicts the deflector subassembly 420 in a first most downhole position such that the seal stinger 422 is installed in the lateral wellbore via seal stinger receptacle 408 in the lateral Y-block bore 404. With the seal stinger 422 positioned in the lateral wellbore, the multi-bore junction assembly 400 may direct an intervention sting to the lateral wellbore. Additionally, flow access for fluid produced from the lateral wellbore may be opened to the central bore of the multi-bore junction assembly 400 (i.e., flow through the deflector sub bore 411 and the central stinger sub bore 433). Fluid produced from the main wellbore may flow into the annulus 438 between the lower outer sleeve 426 and the deflector sub 424 and central stinger sub 430.

In some embodiments, the seal stinger may be held in the first most downhole position by a positioning mechanism, such as positioning mechanism 434. The positioning mechanism 434 may include a bias mechanism, such as a spring assembly, that is bias in the downhole direction. In some embodiments, the positioning mechanism may be a latch mechanism that may hold the deflector sub in the most downhole position.

At block 308, a determination is made of whether access to the other wellbore is to be opened. For example, the computer 190 of FIG. 1 may perform this operation. In some instances, intervention may be needed on the second wellbore and/or fluid produced from the second wellbore may need to flow up the central bore of the multi-bore junction assembly rather than the annulus of the multi-bore junction assembly. For instance, with reference to FIG. 4A, a determination is made of whether the seal stinger 422 needs to be pulled out of the seal stinger receptacle 408 and inserted into the seal stinger receptacle 406 to open access to the main wellbore. If access does not need to be opened to the second wellbore, then operations return to block 308. Otherwise, operations proceed to block 310.

At block 310, the deflector subassembly may be positioned from the first most downhole position to a first most up-hole position. For example, the computer 190 of FIG. 1 may perform this operation. The shifting tool may pull in the up-hole direction to position the deflector subassembly to the first most up-hole position. The first most up-hole position may correspond to the longitudinal distance in which the J-slot allows the deflector subassembly to traverse. For example, the J-slot profile may be configured to allow the deflector subassembly to be moved 50 inches up-hole from the first most downhole position.

Figure 4B:
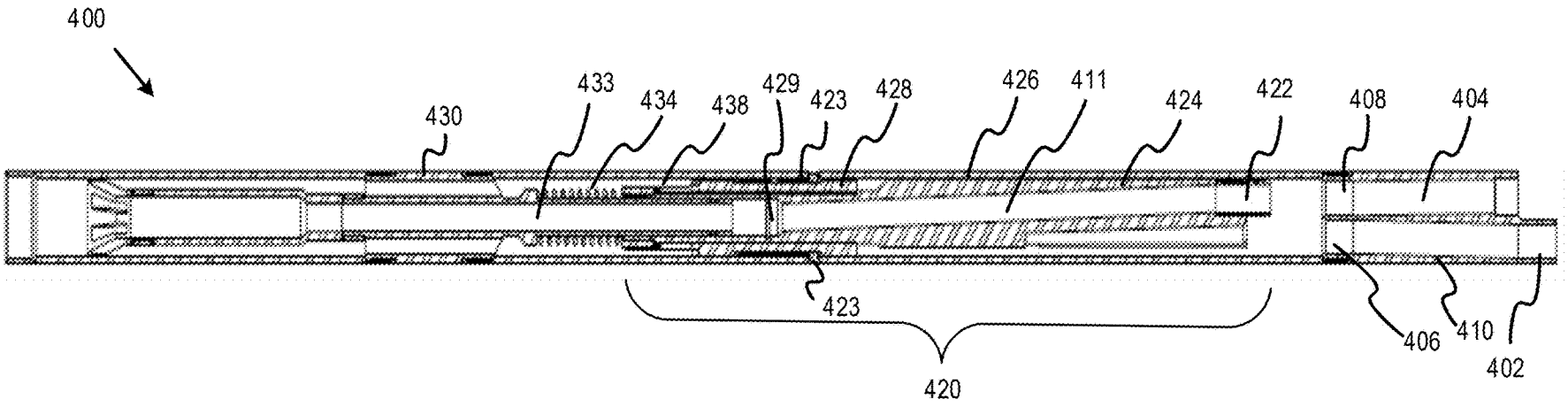
Figure 4C:
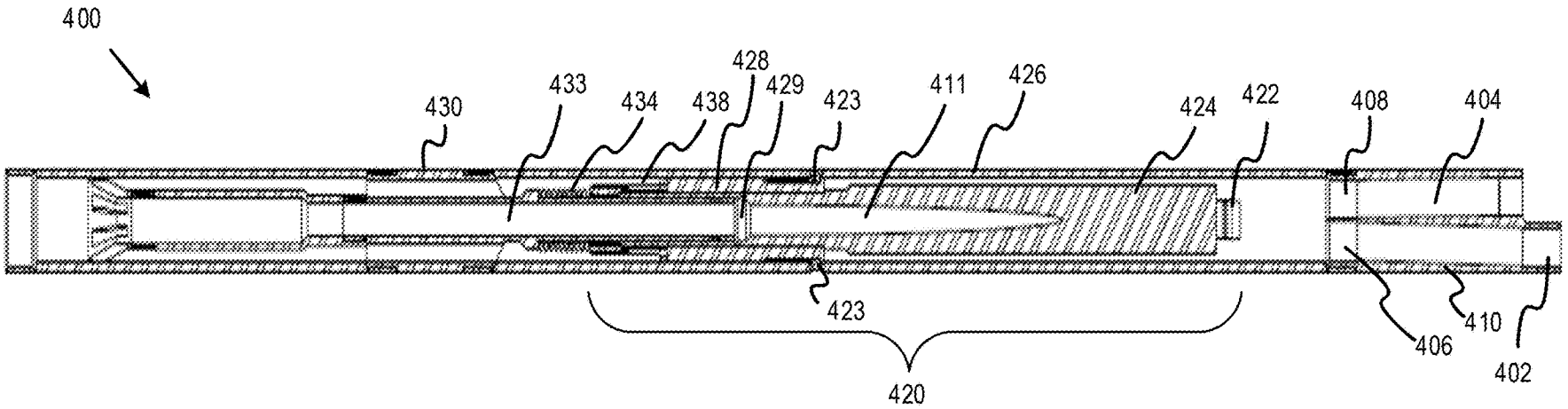

For example, FIG. 4B depicts the deflector subassembly 420 moving in the up-hole direction. As the deflector subassembly 420 is pulled up-hole by the shifting tool, the seal stinger may be unseated from the seal stinger receptacle 408. As the deflector subassembly 420 is moved up-hole to the first most up-hole position, the deflector subassembly 420 may rotate 90 degrees (in either direction, depending on the profile of the J-slots in J-slot sub 428) about the central axis of the multi-bore junction assembly as depicted in FIG. 4C. The profile of the J-slots in the J-slot sub 428 may cause the deflector subassembly 420 to rotate due to the J-slots interacting with the pins 423 fixed on the lower outer sleeve 426.

In some embodiments, the positioning mechanism 434 may be affected by the up-hole movement of the deflector subassembly 420. For instance, a spring assembly may be compressed against the up-hole end of the deflector subassembly 420. In some embodiments, the position mechanism may include a latch mechanism. The shifting tool may release the latch mechanism prior to pulling the deflector subassembly 420 in the up-hole direction.

At block 312, the deflector subassembly is positioned from the first most up-hole position to the second most downhole position such that the seal stinger is installed in the second wellbore. For example, the computer 190 of FIG. 1 may perform this operation. The shifting tool may push in the downhole direction to position the deflector subassembly in the second most downhole position. In some embodiments, the deflector subassembly may be moved in the downhole direction by a position mechanism (i.e., a spring assembly that may be biased in the downhole direction). The second most downhole position may correspond to the seal stinger being positioned in the second wellbore. When the seal stinger is positioned in the second wellbore, access is opened to the second wellbore (the other of either the main wellbore or the lateral wellbore). Thus, intervention strings may now access the second wellbore. Additionally, fluid produced from the second wellbore may flow up the central bore of the multi-bore junction assembly and fluid produced from the first wellbore may flow up the annulus of the multi-bore junction assembly.

Figure 4D:
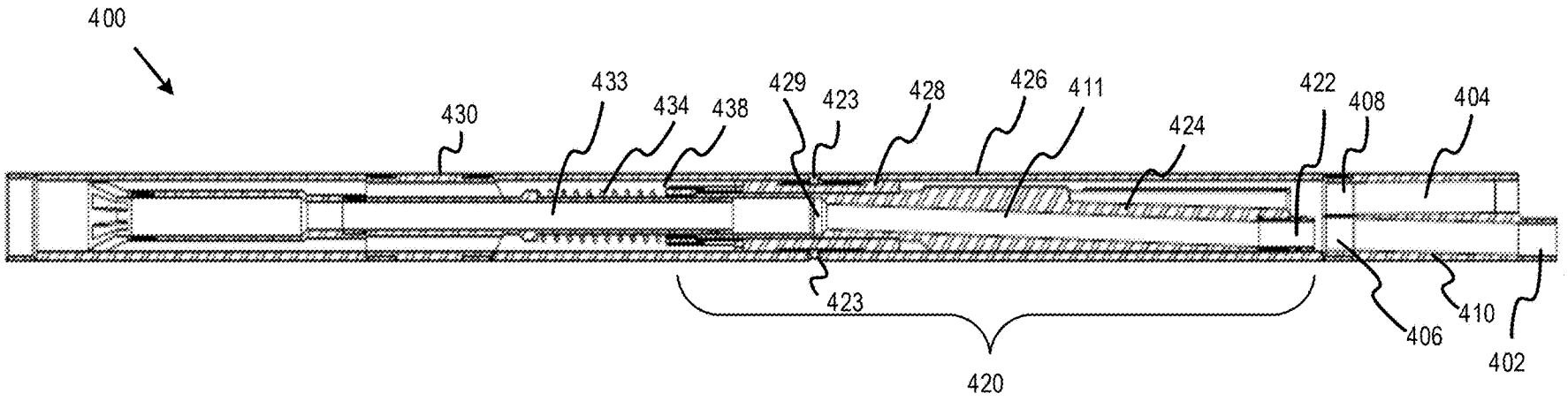
Figure 4E:
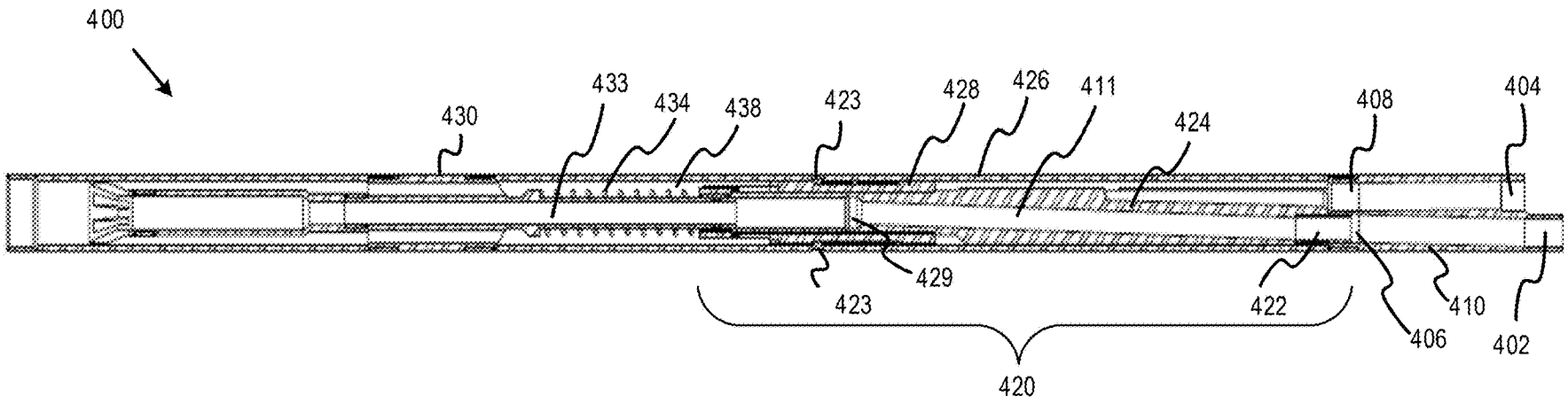

For example, FIG. 4D depicts the deflector subassembly moving in the downhole direction. As the deflector subassembly 420 is moved downhole to towards the second most downhole position, the deflector subassembly 420 may rotate 90 degrees (in in the same direction as the rotation in block 310 when moving in the up-hole direction) about the central axis of the multi-bore junction assembly. The profile of the J-slots of the J-slot sub 428 as it interacts with the pins 423 may cause the deflector subassembly 420 to rotate. By rotating 90 degrees, the seal stinger may align with the seal stinger receptacle 406. As the deflector subassembly 420 continues to move in the downhole direction, the seal stinger 422 is positioned in the seal stinger receptacle 406, opening access to the main wellbore, as depicted in FIG. 4E.

In some embodiments, the positioning mechanism 434 may hold the seal stinger in place once positioned in the seal stinger receptacle. For example, a spring assembly may be biased towards the downhole direction, thus holding the seal stinger in the seal stinger receptacle. In some embodiments, the positioning mechanism 434 may include a latch mechanism. A shifting tool may change the state of the latch mechanism once the seal stinger is landed in the seal stinger receptacle. For example, the shifting tool may shear a pin, drop a ball, increase/decrease flow rate and/or pressure, etc. to change the state of the latch mechanism and allow the latch mechanism to secure the deflector sub in the downhole position.

At block 314, a determination is made of whether to return the opening of access to the first wellbore. For example, the computer 190 of FIG. 1 may perform this operation. In some instances, intervention may be needed on the first wellbore and/or fluid produced from the first wellbore may need to flow up the central bore of the multi-bore junction assembly rather than the annulus of the multi-bore junction assembly. If access does not need to be opened to the first wellbore, then operations return to block 314. Otherwise, operations proceed to block 316.

At block 316, the deflector subassembly is positioned from the second most downhole position to a second most up-hole position. For example, the computer 190 of FIG. 1 may perform this operation. The shifting tool may pull in the up-hole direction to position the deflector subassembly to the second most up-hole position. In some embodiments, if a positioning mechanism includes a latch mechanism, the shifting tool may release the latch mechanism prior to pulling the deflector subassembly in the up-hole direction. When pulled in the up-hole direction, the seal stinger may unseat from the seal stinger receptacle in which it is currently positioned. Once the deflector subassembly is in the second most up-hole position, operations return to block 306 to position the deflector subassembly in the first most downhole position to cycle the sealing assembly back to the first wellbore.

Example Computer

FIG. 5 depicts an example computer, according to some embodiments. FIG. 5 depicts a computer 500 that includes a processor 501 (possibly including multiple processors, multiple cores, multiple nodes, and/or implementing multi-threading, etc.). The computer 500 includes a memory 507. The memory 507 may be system memory or any one or more of the above already described possible realizations of machine-readable media. The computer 500 also includes a bus 503 and a network interface 505.

The computer 500 also includes an orientation detector 511 and a controller 515. The orientation detector 511 and the controller 515 may perform one or more of the operations described herein. For example, the orientation detector 511 may determine the orientation of the deflector subassembly in a multi-bore junction assembly with respect to the main wellbore and the lateral wellbore (e.g., see discussion of FIGS. 3 and 4A-4E). The controller 515 may perform various control operations to control a shifting tool based on the output from the simulation processor 611. For example, the controller 515 may shift the deflector subassembly of a multi-bore junction assembly from a lateral wellbore to a main wellbore.

Any one of the previously described functionalities may be partially (or entirely) implemented in hardware and/or on the processor 501. For example, the functionality may be implemented with an application specific integrated circuit, in logic implemented in the processor 501, in a co-processor on a peripheral device or card, etc. Further, realizations may include fewer or additional components not illustrated in FIG. 5 (e.g., video cards, audio cards, additional network interfaces, peripheral devices, etc.). The processor 501 and the network interface 505 are coupled to the bus 503. Although illustrated as being coupled to the bus 503, the memory 507 may be coupled to the processor 501.

EXAMPLE EMBODIMENTS

Embodiment #1: A multi-bore junction assembly to be positioned in a multilateral well having a main wellbore and a lateral wellbore, wherein the multilateral well has an up-hole end and a downhole end, the multi-bore junction assembly comprising: a deflector subassembly to be positioned at a junction between the main wellbore and the lateral wellbore, the deflector subassembly comprising, a deflector sub that comprises, a first deflector bore at an up-hole end of the deflector sub; and a second deflector bore at a downhole end of the deflector sub, wherein the second deflector bore is radially offset from the first deflector bore; a seal stinger to project from the second deflector bore; and a slot sub; and an outer sleeve positioned around the deflector subassembly, the outer sleeve having at least one pin, wherein the slot sub is to interact with the at least one pin.

Embodiment #2: The multi-bore junction assembly of Embodiment #1, comprising: a Y-block sub to be positioned at the junction and at the downhole end of the outer sleeve, the Y-block sub comprising, a first Y-block bore at the downhole end of the Y-block sub and to be positioned in the main wellbore, wherein a first seal stinger receptacle is positioned at the up-hole end of the first Y-block bore; and a second Y-block bore at the downhole end of the Y-block sub and to be positioned in the lateral wellbore, wherein a second seal stinger receptacle is positioned at the up-hole end of the second Y-block bore.

Embodiment #3: The multi-bore junction assembly of Embodiment #2, wherein the seal stinger is to project into the first seal stinger receptacle or the second seal stinger receptacle.

Embodiment #4: The multi-bore junction assembly of Embodiment #2, comprising a positioning mechanism to be positioned up-hole of the deflector subassembly, the positioning mechanism configured to hold the seal stinger in the first seal stinger receptacle or the second seal stinger receptacle.

Embodiment #5: The multi-bore junction assembly of Embodiment #2, wherein the first Y-block bore is configured to receive a first fluid produced from the main wellbore into the multi-bore junction assembly; and wherein the second Y-block bore is configured to receive a second fluid produced from the lateral wellbore into the multi-bore junction assembly, such that the first fluid is segregated from the second fluid when flowing through the multi-bore junction assembly.

Embodiment #6: The multi-bore junction assembly of any one or more of Embodiments #1-5, comprising: a central stinger sub positioned at an up-hole end of the outer sleeve, the central stinger sub comprising, a bore centralized with the first deflector bore; and at least one port offset from a central axis of the central stinger sub.

Embodiment #7: The multi-bore junction assembly of Embodiment #6, comprising: an upper completion subassembly positioned at an up-hole end of the central stinger sub, the upper completion subassembly comprising a bore receptacle and a scoop head.

Embodiment #8: The multi-bore junction assembly of any one or more of Embodiments #1-7, wherein the slot sub comprises a J-slot sub.

Embodiment #9: The multi-bore junction assembly of any one or more of Embodiments #1-8, wherein the at least one pin comprises at least two pins.

Embodiment #10: The multi-bore junction assembly of any one or more of Embodiments #1-9, wherein the deflector subassembly comprises a top cap sub to be positioned at the up-hole end the slot sub.

Embodiment #11: A method for operating access control between a main wellbore and a lateral wellbore of a multilateral well, the method comprising: positioning a multi-bore junction assembly proximate an intersection between the main wellbore and the lateral wellbore; opening of a first access to a first wellbore that is either the main wellbore or the lateral wellbore, wherein the opening of the first access comprises, pushing a deflector subassembly down to a first most downhole position such that a seal stinger of the multi-bore junction assembly is installed in the first wellbore; and opening of a second access to a second wellbore that is the other of the main wellbore or the lateral wellbore that is not the first wellbore, where the opening of the second access comprises, pulling the deflector subassembly from the first most downhole position to a first most up-hole position; and pushing the deflector subassembly from the first most up-hole position to a second most downhole position such that the seal stinger is installed in the second wellbore.

Embodiment #12: The method of Embodiment #11, wherein the multi-bore junction assembly comprises a J-slot sub having a first slot and a second slot, wherein a length of the first slot is different from a length of the second slot.

Embodiment #13: The method of Embodiment #12, comprising: detecting orientation of the multi-bore junction assembly based on an amount of pulling of the deflector subassembly that is based on a difference in length of the first slot and the length of the second slot.

Embodiment #14: The method of Embodiment #13, comprising: determining whether the first access to the first wellbore or the second access to the second wellbore is opened based on the detected orientation.

Embodiment #15: An apparatus to be positioned in a multilateral well having an up-hole end and a downhole end, the apparatus comprising: a Y-block sub comprising, a first Y-block bore at the downhole end of the Y-block sub and to be positioned in a main wellbore, wherein a first seal stinger receptacle is positioned at the up-hole end of the first Y-block bore; a second Y-block bore at the downhole end of the Y-block sub and to be positioned in a lateral wellbore, wherein a second seal stinger receptacle is positioned at the up-hole end of the second Y-block bore; and a deflector subassembly to be positioned at the up-hole end relative to the Y-block sub, wherein the deflector subassembly comprises, a deflector sub that comprises, a first deflector bore at an up-hole end of the deflector sub; and a second deflector bore at a downhole end of the deflector sub, wherein the second deflector bore is radially offset from the first deflector bore; a seal stinger to project from the second deflector bore and into the first seal stinger receptacle or the second seal stinger receptacle; and a slot sub, wherein the slot sub is to interact with at least one pin; and an outer sleeve positioned around the deflector subassembly having the at least one pin.

Embodiment #16: The apparatus of Embodiment #15, wherein the seal stinger is to project into the first seal stinger receptacle or the second seal stinger receptacle.

Embodiment #17: The apparatus of Embodiments #15 or #16, comprising: a central stinger sub positioned at an up-hole end of the outer sleeve, the central stinger sub comprising, a bore centralized with the first deflector bore; and at least one port offset from a central axis of the central stinger sub.

Embodiment #18: The apparatus of Embodiment #17, comprising: an upper completion subassembly positioned at an up-hole end of the central stinger sub, the upper completion subassembly comprising, a bore receptacle and a scoop head.

Embodiment #19: The apparatus of any one or more of Embodiments #15-18, wherein the deflector subassembly comprises a top cap sub to be positioned at the up-hole end of the slot sub.

Embodiment #20: The apparatus of any one or more of Embodiments #15-19, wherein the first Y-block bore is configured to receive a first fluid produced from the main wellbore into the apparatus; and wherein the second Y-block bore is configured to receive a second fluid produced from the lateral wellbore into the apparatus, such that the first fluid is segregated from the second fluid when flowing through the apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" may be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

The invention claimed is:

1. A multi-bore junction assembly to be positioned in a multilateral well having a main wellbore and a lateral wellbore, wherein the multilateral well has an up-hole end and a downhole end, the multi-bore junction assembly comprising:

a deflector subassembly to be positioned at a junction between the main wellbore and the lateral wellbore, the deflector subassembly comprising, a deflector sub that comprises, a first deflector bore, wherein an up-hole end of the first deflector bore is radially offset from a downhole end of the first deflector bore;

a seal stinger to project from the downhole end of the first deflector bore and configured to be installed in a first Y-block bore within a Y-block sub; and a slot sub; and an outer sleeve positioned around the deflector subassembly, the outer sleeve having at least one pin, wherein the slot sub is to interact with the at least one pin, and wherein an annulus between the outer sleeve and the deflector subassembly is open to a second Y-block bore within the Y-block sub upon installation of the seal stinger in the first Y-block bore.

2. The multi-bore junction assembly of claim 1, wherein the Y-block sub is to be positioned at the junction and at the downhole end of the outer sleeve, the Y-block sub comprising, the first Y-block bore at the downhole end of the Y-block sub and to be positioned in the main wellbore, wherein a first seal stinger receptacle is positioned at the up-hole end of the first Y-block bore; and the second Y-block bore at the downhole end of the Y-block sub and to be positioned in the lateral wellbore, wherein a second seal stinger receptacle is positioned at the up-hole end of the second Y-block bore.

3. The multi-bore junction assembly of claim 2, wherein the first Y-block bore is configured to receive a first fluid produced from the main wellbore into the multi-bore junction assembly; and wherein the second Y-block bore is configured to receive a second fluid produced from the lateral wellbore into the multi-bore junction assembly, such that the first fluid is segregated from the second fluid when flowing through the multi-bore junction assembly.

4. The multi-bore junction assembly of claim 2, wherein the seal stinger is to project into the first seal stinger receptacle or the second seal stinger receptacle.

5. The multi-bore junction assembly of claim 2, comprising a positioning mechanism to be positioned up-hole of the deflector subassembly, the positioning mechanism configured to hold the seal stinger in the first seal stinger receptacle or the second seal stinger receptacle.

6. The multi-bore junction assembly of claim 1, comprising:

a central stinger sub positioned at an up-hole end of the outer sleeve, the central stinger sub comprising, a bore centralized with the first deflector bore; and at least one port offset from a central axis of the central stinger sub.

7. The multi-bore junction assembly of claim 6, comprising:

an upper completion subassembly positioned at an up-hole end of the central stinger sub, the upper completion subassembly comprising a bore receptacle and a scoop head.

8. The multi-bore junction assembly of claim 1, wherein the slot sub comprises a J-slot sub.

9. The multi-bore junction assembly of claim 1, wherein the at least one pin comprises at least two pins.

10. The multi-bore junction assembly of claim 1, wherein the deflector subassembly comprises a top cap sub to be positioned at the up-hole end the slot sub.

11. A method for operating access control between a main wellbore and a lateral wellbore of a multilateral well, the method comprising:

positioning a multi-bore junction assembly proximate an intersection between the main wellbore and the lateral wellbore;

opening of a first access to a first wellbore that is either the main wellbore or the lateral wellbore, wherein the opening of the first access comprises, pushing a deflector subassembly down to a first most downhole position such that a seal stinger of the multi-bore junction assembly is installed in the first wellbore, wherein a second wellbore is open to an annulus between the deflector subassembly and an outer sleeve positioned around the deflector subassembly; and opening of a second access to the second wellbore that is the other of the main wellbore or the lateral wellbore that is not the first wellbore, where the opening of the second access comprises, pulling the deflector subassembly from the first most downhole position to a first most up-hole position; and pushing the deflector subassembly from the first most up-hole position to a second most downhole position such that the seal stinger is installed in the second wellbore, wherein the first access to the first wellbore is open to the annulus between the deflector subassembly and the outer sleeve positioned around the deflector subassembly.

12. The method of claim 11, wherein the multi-bore junction assembly comprises a J-slot sub having a first slot and a second slot, wherein a length of the first slot is different from a length of the second slot.

13. The method of claim 12, comprising:

detecting orientation of the multi-bore junction assembly based on an amount of pulling of the deflector subassembly that is based on a difference in length of the first slot and the length of the second slot.

14. The method of claim 13, comprising:

determining whether the first access to the first wellbore or the second access to the second wellbore is opened based on the detected orientation.

15. An apparatus to be positioned in a multilateral well having an up-hole end and a downhole end, the apparatus comprising:

a Y-block sub comprising, a first Y-block bore at the downhole end of the Y-block sub and to be positioned in a main wellbore, wherein a first seal stinger receptacle is positioned at the up-hole end of the first Y-block bore;

a second Y-block bore at the downhole end of the Y-block sub and to be positioned in a lateral wellbore, wherein a second seal stinger receptacle is positioned at the up-hole end of the second Y-block bore; and a deflector subassembly to be positioned at the up-hole end relative to the Y-block sub, wherein the deflector subassembly comprises, a deflector sub that comprises, a first deflector bore, wherein an up-hole end of the first deflector bore is radially offset from a downhole end of the first deflector bore;

a seal stinger to project from the downhole end of the first deflector bore and into the first seal stinger receptacle or the second seal stinger receptacle; and a slot sub, wherein the slot sub is to interact with at least one pin; and an outer sleeve positioned around the deflector subassembly having the at least one pin, wherein an annulus between the outer sleeve and the deflector subassembly is open to either the first Y-block bore or the second Y-block bore upon installation of the seal stinger into the other of the first Y-block bore or the second Y-block bore.

16. The apparatus of claim 15, wherein the seal stinger is to project into the first seal stinger receptacle or the second seal stinger receptacle.

17. The apparatus of claim 15, comprising:

a central stinger sub positioned at an up-hole end of the outer sleeve, the central stinger sub comprising, a bore centralized with the first deflector bore; and at least one port offset from a central axis of the central stinger sub.

18. The apparatus of claim 17, comprising:

an upper completion subassembly positioned at an up-hole end of the central stinger sub, the upper completion subassembly comprising, a bore receptacle and a scoop head.

19. The apparatus of claim 15, wherein the deflector subassembly comprises a top cap sub to be positioned at the up-hole end of the slot sub.

20. The apparatus of claim 15, wherein the first Y-block bore is configured to receive a first fluid produced from the main wellbore into the apparatus; and wherein the second Y-block bore is configured to receive a second fluid produced from the lateral wellbore into the apparatus, such that the first fluid is segregated from the second fluid when flowing through the apparatus.

* * * * *